United States Patent [19]

Rösler

[11] 4,159,851

[45] Jul. 3, 1979

[54] DRIVE FRAME AND ASSEMBLY FOR MINING APPARATUS

[75] Inventor: Wulff Rösler, Lunen, Fed. Rep. of Germany

[73] Assignee: Gewerkschaft Eisenhutte Westfalia, Lunen, Fed. Rep. of Germany

[21] Appl. No.: 797,215

[22] Filed: May 16, 1977

[30] Foreign Application Priority Data

May 22, 1976 [DE] Fed. Rep. of Germany ..... 2623066

[51] Int. Cl.[2] ..... E21C 29/16

[52] U.S. Cl. ..... 299/43; 299/34; 74/606 R

[58] Field of Search ..... 299/34, 43, 42; 74/606, 74/31, 422; 105/29 R

[56] References Cited

U.S. PATENT DOCUMENTS

| | | | |
|---|---|---|---|
| 2,197,377 | 4/1940 | Hait | 74/606 |
| 2,783,654 | 3/1957 | Carnell | 74/606 |
| 3,576,142 | 4/1971 | Matthews | 74/606 |
| 3,610,055 | 10/1971 | Parris | 74/606 R |
| 3,992,956 | 11/1976 | Fischer | 74/606 R |

FOREIGN PATENT DOCUMENTS

| | | | |
|---|---|---|---|
| 1035962 | 7/1966 | United Kingdom | 299/34 |

*Primary Examiner*—William Pate, III

*Attorney, Agent, or Firm*—Sughrue, Rothwell, Mion, Zinn and Macpeak

[57] ABSTRACT

A drive frame for the drive assembly of a mining installation has a pair of side plates and a connector. The mining installation is of the type having a winning machine and a conveyor. The connector is fastened to one of the side plates of the drive frame and constitutes means for mounting respective drive units for the winning machine and the conveyor. The connector is constituted by a respective mounting plate for each of the drive units. The two mounting plates are connected to one another in a tension-proof manner. The connector is provided with an annular collar which mates with an aperture in said one side plate to support and align the connector.

14 Claims, 3 Drawing Figures

DRIVE FRAME AND ASSEMBLY FOR MINING APPARATUS

BACKGROUND OF THE INVENTION

The invention relates to a drive frame for a drive assembly or station of mining apparatus including a conveyor and a coal-winning machine such as a plough.

For the removal of material in underground mining operations, it is well known (see DT-OS No. 2,208,657, DT-Gbm No. 1,923,926 and DT-Gbm No. 1,880,713) to use a scraper chain conveyor which has, at each end thereof, a drive frame for locating a chain drum which is used to drive the chain or chains of the conveyor. At least one of the drive frames provides support for the drive units of the conveyor and of the coal-winning machine, these units being mounted to a side plate of the drive frame by means of flanges. Where the coal-winning machine is a plough, the plough drive unit is attached to a chain sprocket case which contains a chain sprocket which transmits the drive to the plough by means of a chain. In this case, the chain sprocket case is attached to the drive frame. With a view to transmitting the tensile forces of the plough chain to the drive frame, the known type of chain sprocket case is provided with special spigots which extend into bores in the side plate of the drive frame. In the so-called F-arrangement the conveyor drive unit and the plough drive unit are arranged side-by-side on the goaf side of the drive frame.

It is the aim of the invention to provide an improved drive frame for the drive assembly of a mining apparatus including a conveyor and a coal-winning machine, the drive frame being constructed in such a way that, with optimum transmission of the forces to the drive frame, the drive units of the conveyor and the coal-winning machine can be mounted closely side-by-side.

SUMMARY OF THE INVENTION

The present invention provides a drive frame for the drive assembly of a mining installation constituted by a winning machine and a conveyor, the drive frame being provided with a connector which, in use, is fastened to one of its side plates and to which connector can be detachably connected respective drive units for the conveyor and the winning machine, the connector being constituted by a respective mounting plate for each of the drive units and the two mounting plates being connected to one another in a tension-proof manner, wherein the connector is provided with an annular collar which, in use, extends into an aperture in said one side plate to support and align the connector.

Advantageously, the two mounting plates are formed integrally with one another so that the connector is of one-piece construction, and preferably, the connector is a one-piece casting.

Preferably, a coupling means is provided for locking the connector to said one side plate in a non-rotational manner, the coupling member being spaced from the annular collar. This coupling means may be constituted by a key on either the connector or said one side plate and a matching groove in the other of these two parts.

At least one of the mounting plates may be provided with an oil-retaining cavity.

The invention also provides a drive assembly for a mining installation constituted by a chain-driven winning machine and a chain-driven conveyor, the drive assembly comprising a drive frame as defined above and respective drive units for the winning machine and the conveyor, the two drive units being mounted side-by-side on the respective mounting plates of the drive frame connector.

Preferably, a chain drum for driving the conveyor is mounted within the drive frame and aligned with the aperture in said one side plate.

Advantageously, the mounting plate of the drive unit for the winning machine is constructed as a chain sprocket case.

Thus, with this assembly, the tensile force of the winning machine chain is absorbed by the annular collar which extends into the aperture in the drive frame, so that special spigots and their costly formation on the mounting plate forming the chain sprocket case can be omitted. The winning machine (usually a plough) chain sprocket can be positioned close to the conveyor drive unit which is also advantageous. Moreover, when the two mounting plates are integrally formed so as to form a one-piece connector, it is comparatively simple to carry out the fitting of the drive units. This is particularly so for the plough drive unit, since a separate fitting for the plough chain sprocket case is not required. A further advantage is that the plough chain sprocket can be positioned close to the side plate of the drive frame so that any misalignment between the plough chain as it enters the chain guides is largely prevented.

The drive units are fastened to the mounting plates by means of bolts, and the connector is similarly fastened to the drive frame. However, because of the connection of the connector to the drive frame through the annular collar, and because of the torque limiting coupling means, these bolts are not subjected to the stresses. The entire connector is at the same time centered and aligned by means of the annular collar which also facilitates the installation. In the case of a drive frame of short construction, it is possible for the connector to have a length which exceeds that of the drive frame. The connector may also be constructed in the form of a skid for supporting the drive assembly on the floor of a mine working.

BRIEF DESCRIPTION OF THE DRAWINGS

A drive assembly for a mining installation and incorporating a drive frame constructed in accordance with the invention, will now be described, by way of example, with reference to the accompanying drawings, in which.

DESCRIPTION OF PREFERRED EMBODIMENT

Figure 1:
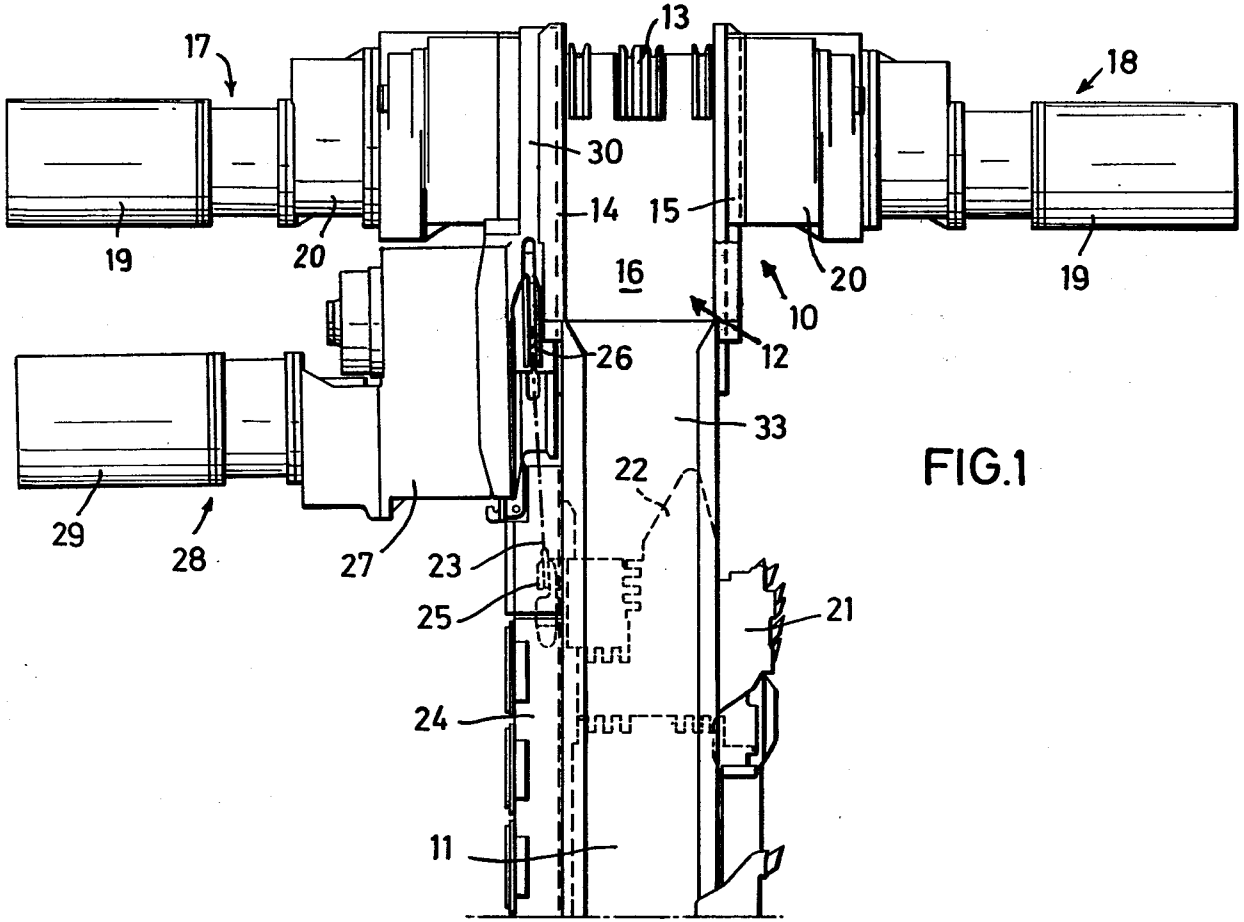
FIG. 1 is a plan view of the drive assembly showing the F-arrangement of the drive units.

Referring to the drawings, FIG. 1 shows a drive assembly 10 of a mining installation constituted by a conveyor 11 and a coal-winning machine 21. The conveyor 11 is a scraper chain conveyor. At each end of the conveyor 11, there is a drive frame 12 which contains a chain drum 13 for the endless chain (or chains) which drive the scraper chain conveyor, and which are equipped with scrapers. At least one of these drive frames 12 is provided with drive units for both the conveyor 11 and the winning machine 21. The drive frame 12 is constituted by two parallel, vertical side plates 14 and 15 which are rigidly connected together by a welded conveyor centre plate 16 and other cross-members (not shown).

The driving of the scraper chain conveyor 11 is effected by two drive units 17 and 18, each of which comprises an electric motor 19 and a gear 20, the gear output shafts of which being constructed as tubular shafts which are connected directly (or indirectly through intermediate shafts) to the shaft ends of the chain drum 13.

A plough, which constitutes the winning machine 21, is guided on the scraper chain conveyor 11, a sword plate 22 of the plough extending under the scraper chain conveyor. The plough 21 is driven by means of an endless plough chain 23, which is guided in chain guides 24 at the goaf side of the conveyor 11, the lower run of this chain being attached to guide blocks 25 fastened to the sword plate 22.

The plough chain 23 is driven at both ends of the conveyor 11 by means of respective plough chain sprockets 26 (only one of which is illustrated in FIG. 1), each sprocket being of a respective plough gear 27 which forms part of a plough drive unit 28. Each plough drive unit 28 also has an electric motor 29 and is positioned side-by-side with the conveyor drive unit 17 on the side plate 14 of the drive frame 12.

Figure 2:
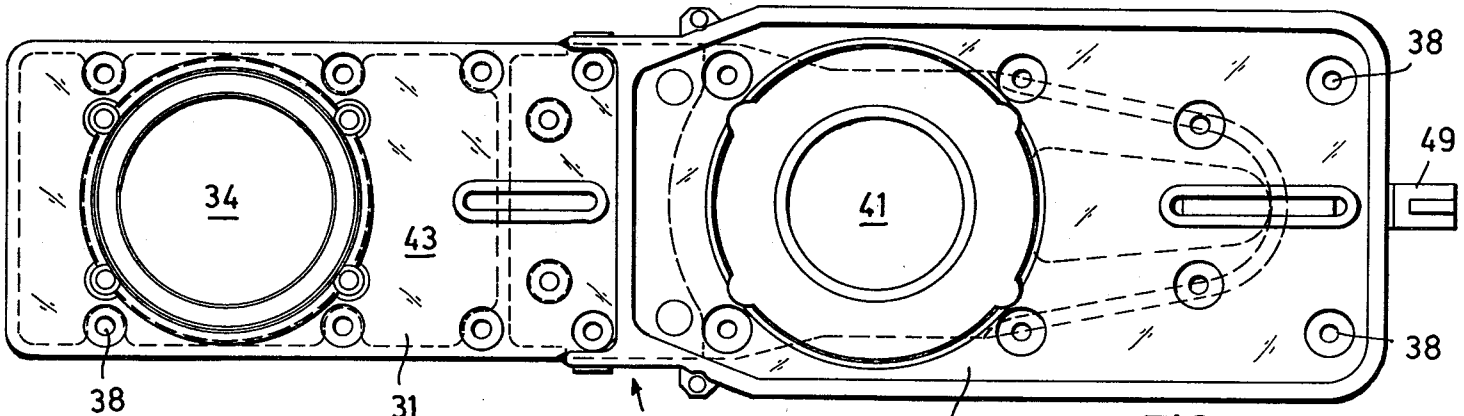
FIG. 2 is a side elevation of part of the drive frame of the assembly of FIG. 1.
Figure 3:
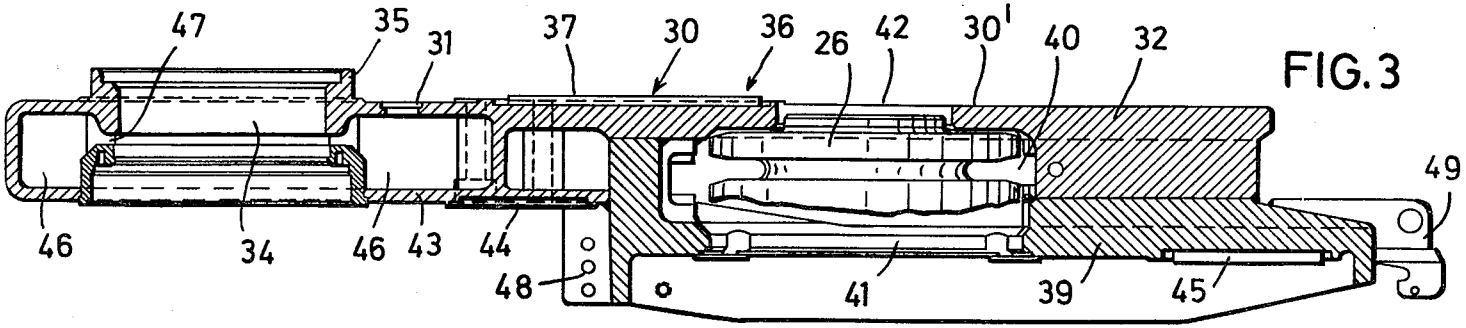
FIG. 3 is a longitudinal cross-section of the part of the drive frame shown in FIG. 2.

The two drive units 17 and 28 are connected to the drive frame 12 by a connector 30 which is shown in detail in FIGS. 2 and 3. The connector 30 is constituted by two mounting plates 31 and 32 which are connected to each other in a tension proof manner. In the illustrated embodiment, the two plates 31 and 32 are of integral construction so as to form a one-piece connector 30, which preferably is a one-piece casting. As can be seen in FIG. 1, the length of the connector 30 exceeds the length of the drive frame 12. The plough chain sprocket 26 thus lies in the transition zone between the drive frame 12 and an intermediate connecting portion 35 which is interposed between the adjacent endmost pan of the conveyor 11 and the drive frame.

The plate 31 of the connector 30 is provided with a bearing aperture 34 and with an annular collar 35 which projects beyond the inner side 30' of the connector, the external diameter of which collar substantially equals the internal diameter of a bearing aperture (not shown) for the chain drum 13, this latter aperture being arranged, in known manner, in the side plate 14 of the drive frame 12. The diameter of this latter bearing aperture is so dimensioned that the chain drum 13 can be withdrawn laterally therefrom.

The projecting annular collar 35 is introduced into the bearing aperture in the side plate 14 when the connector 30 is attached to the drive frame 12, whereby the connector is centred and aligned. The connector 30 is rotationally locked with respect to the side plate 14 by means of a special coupling 36 which consists of at least one key 37 which mates with a corresponding groove in the side plate. The key 37 can consist of a bar which is fixed to the connector 30 or to the side plate 11, and which extends into a corresponding groove of the other part and thus connects the connector to the side plate in a rotationally locked manner. The connector 30 is attached to the side plate 14 by means of special bolts which pass through bolt-holes 38 in the connector.

The plate 32 of the connector 30 is constructed as a plough chain sprocket case, and is provided with a welded projection 39 which forms a space 40 for the location of the plough chain sprocket 26. The projection 39 and the plate 32 are provided with lateral openings 41 and 42 which open into the space 40 for receiving the plough chain sprocket 26.

The two drive units 17 and 28 are mounted by means of flanges (not shown) on the connector 30. The drive unit 17 is connected to its gear 20 by means of bolts which penetrate bolt-holes in the front wall 43 of the plate 31. The driving connection between the conveyor drive unit 17 and the chain drum 13 is effected through the bearing aperture 34.

The gear 27 of the drive unit 28 is connected to the projection 39 of the plate 32 by means of bolts. The connection of the gears 20 and 27 to the connector 30 is effected in a rotationally locked manner by means of keys 44 and 45 which mate with corresponding grooves (not shown) in the gear housing.

The plate 31 is double walled so as to provide an internal chamber 46 which surrounds the bearing aperture 34 and constitutes an oil reservoir. The chamber 46 is connected, via passages 47, to the interior of the drive frame 12 for the lubrication of the shaft bearings.

It will be apparent that the tensile forces of the plough chain 23 are transmitted from the chain sprocket 26 through the connector 30 and its annular collar 35 directly to the side plate 14 of the drive frame 12. The torque of the drive units 17 and 28, which are mounted on the connector 30, however, is absorbed by the torque coupling 36.

Connecting elements 48 for the connection of an advancing ram are also provided on the connector 30. The connector 30 is also provided, at one end, with a hook 49 for ease of transportation. The usual chain stripper which is associated with the plough chain sprocket 26 can also be attached to this end of the connector 30.

It will be apparent that the plough chain sprocket 26 can be positioned closely to the conveyor drive unit 17 and that it is also located at a small distance from the side plate 14 of the drive frame 12. Consequently, the plough chain 23 is not subjected to any violent lateral deflections in the region of the chain sprocket 26.

I claim:

1. A drive frame for the drive assembly of a mining installation constituted by a winning machine and a conveyor, comprising; a pair of side plates for said drive frame, a connector fastened to one of the side plates, the connector including means for the connection of respective drive units for the conveyor and the winning machine, the connector having a respective mounting plate for each of the drive units and each of the mounting plates being connected to one another in a tension-proof manner, an annular collar extending into an aperture in said one side plate to support and align the connector, and coupling means for locking the connector to said one side plate in a non-rotational manner, the coupling means being spaced from the annular collar.

2. A drive frame according to claim 1, wherein the two mounting plates are formed integrally with one another so that the connector is of one-piece construction.

3. A drive frame according to claim 2, wherein the connector is a one-piece casting.

4. A drive frame according to claim 1, wherein the coupling means comprises a key on the connector and a matching groove in said one side plate.

5. A drive frame according to claim 1, wherein at least one of the mounting plates is provided with an oil-retaining cavity.

6. A drive assembly for a mining installation constituted by a chain-driven winning machine and a chain-driven conveyor, the drive assembly comprising a drive frame and respective drive units for the winning machine and the conveyor, the drive frame having a pair of side plates and a connector which is fastened to one of the side plates, the connector having two mounting plates connected to one another in a tension-proof manner, the two drive units being mounted side-by-side on the mounting plates of the connector, and an annular collar extending into an aperture in said one side plate to support and align the connector.

7. A drive assembly according to claim 6, further including a chain drum for driving the conveyor, said drum mounted within the drive frame and aligned with the aperture in said one side plate.

8. A drive assembly according to claim 6, wherein the mounting plate of the drive unit for the winning machine is constructed as a chain sprocket case.

9. A drive assembly according to claim 6, wherein the conveyor drive unit mounting plate is provided with an oil-retaining cavity.

10. A drive assembly according to claim 9, wherein said cavity is annular and surrounds the bearing of the output shaft of the conveyor drive unit.

11. A drive assembly according to claim 6, wherein the connector is provided with connection means for a hydraulic advance ram.

12. A drive assembly according to claim 11, wherein said connection means is formed on a projection welded onto the connector.

13. A drive assembly according to claim 6, wherein the connector is connected to said one side plate in such a manner that all the tensile forces of the winning machine chain are transmitted into the drive frame via the annular collar.

14. A drive frame for the drive assembly of a mining installation constituted by a winning machine and a conveyor, comprising a pair of side plates for said drive frame, a connector fastened to one of the side plates, the connector having means for the connection of respective drive units for the conveyor and the winning machine, the length of the connector exceeding the length of said one side plate, the connector including a respective mounting plate for each of the drive units and each of the mounting plates being connected to one another in a tension-proof manner, and an annular collar extending into an aperture in said one side plate to support and align the connector.

* * * * *